US005320071A

United States Patent [19]

Valenti et al.

[11] Patent Number: 5,320,071

[45] Date of Patent: Jun. 14, 1994

[54] DEVICE FOR INDIRECTLY HEATING FLUIDS

[75] Inventors: Quintiliano Valenti; Francesco Giacobbe; Raffaele Villante, all of Rome; Maurizio Bezzeccheri, Pompei, all of Italy

[73] Assignee: Mannesmann Aktiengesellschaft, Dusseldorf, Fed. Rep. of Germany

[21] Appl. No.: 934,677

[22] PCT Filed: Feb. 27, 1991

[86] PCT No.: PCT/DE91/00183

§ 371 Date: Nov. 9, 1992

§ 102(e) Date: Nov. 9, 1992

[87] PCT Pub. No.: WO91/14139

PCT Pub. Date: Sep. 19, 1991

[30] Foreign Application Priority Data

Mar. 5, 1990 [IT] Italy ..... 47720 A/90

[51] Int. Cl.[5] ..... F22B 5/02

[52] U.S. Cl. ..... 122/18; 122/19; 122/250 R; 122/367.1; 122/367.3; 165/182

[58] Field of Search ..... 122/245, 367.1, 367.3, 122/13.1, 18, 19, 248, 250 R; 165/181, 182

[56] References Cited

U.S. PATENT DOCUMENTS 2,578,136 12/1951 Huet ..... 122/367.3 X
4,886,018 12/1989 Ferroli ..... 122/367.3

FOREIGN PATENT DOCUMENTS 1250825 8/1986 U.S.S.R. ..... 122/367.3

*Primary Examiner*—Edward G. Favors
*Attorney, Agent, or Firm*—Cohen, Pontani, Lieberman, Pavane

[57] ABSTRACT

A device for indirectly heating fluids, particularly for high temperature processes, includes a heating space in which at least one tube coil is arranged. The tube coil is constructed in a planar manner and the fluid to be heated can be conducted through the tube coil. Heat radiators act from the outside on the tube coil. The heat radiators have a heat radiation surface shaped corresponding to the planar extension of the tube coil. The heat radiators are arranged on opposite sides of the tube coil. Longitudinal ribs are provided on two opposite sides of the tube of the tube coil with respect to the tube cross section. The longitudinal ribs extend along the entire or almost entire length of the tube coil into the intermediate space situated between the loops of the tube coil 12 Claims, 5 Drawing Sheets

DEVICE FOR INDIRECTLY HEATING FLUIDS

BACKGROUND OF THE INVENTION

1. Field of the Invention

The invention is directed to a device for indirectly heating fluids, particularly for high temperature processes. The device includes a heating space in which at least one tube coil is arranged. The tube coil is constructed in a planar member and the fluid to be heated can be conducted through the tube coil. Radiation heat of a heat radiator may act from the outside on the tube coil.

2. Description of the Related Art

Such devices are required particularly for carrying out high temperature processes which occur frequently in oil refining and petrochemistry. The fluid to be heated, e.g. liquid or gaseous hydrocarbons or a mixture of hydrocarbons and steam, is conventionally guided through a heating space in heat exchanger tubes and heated by the tube wall of the heat exchanger tubes without coming into direct contact with the heating medium. The transfer of heat to the tube wall is usually primarily effected by heat radiation which proceeds from an open flame of a combustible material burned in the heating space and to a small extent by the hot combustion gases by way of convection. The heat exchanger tubes run through the heating space in the form of tube coils.

The great disadvantage of open flames is that it is very difficult to adjust a desired geometric form of the flame and a temperature distribution which is as uniform as possible. Uniform heating ratios are therefore very difficult to achieve particularly under variable operating conditions. The boundaries for corresponding intervention for purposes of control are very narrow in practice. Changes in the flame geometry are equivalent to changes in the distance of individual locations of the heat exchanger tubes from the "flame surface". This means that the flow of heat through the heat exchanger tubes always fluctuates considerably not only along the tube coil. In particular, a nonuniform flow of heat can also be determined along the circumference of the heat exchanger tubes, since the individual partial pieces of the tube surface differ in their alignment with respect to the flame in a compulsory manner and are sometimes even remote from the flame and accordingly irradiated at different intensities. This can lead to localized overheating at isolated points of the heat exchanger tubes and simultaneously to a considerable drop below the desired tube wall temperature at other locations. Accordingly, thermal damage to the heat exchanger tubes can occur proceeding from the outside on the one hand and undesirable effects can also be triggered with respect to the fluid to be heated (e.g. coking of the inner surface of the tubes) on the other hand. In conventional furnaces for high temperature processes, the differences are often so great that the ratio of the maximum to mean heat flow in the walls of the heat exchanger tubes can lie in the range of 3:1 to 4:1.

It is known in practice to burn gaseous combustibles (gas or evaporated liquid combustibles) without flame formation in a burner with a heat radiation surface in that the gaseous combustible which is mixed with an oxygen containing gas (e.g. air) is guided through a porous radiation body and ignited and burned on its outer surface. The ignition is effected by the glowing of this outer surface (heat radiation surface). Corresponding to the geometric form of the radiation body, the heat radiation surface has a regular shape which, in contrast to an open flame, does not change when the supply of combustible material changes. Moreover, the temperature distribution within the heat radiation surface is very uniform.

Such a burner with heat radiation surface (heat radiator) is known e.g. from U.S. Pat. No. 4,722,681. Its radiation body is formed from a ceramic fiber matrix and has great length and width compared to the physical depth of the burner, resulting in a large heat radiation surface. This burner is provided for thermally treating long webs of paper or woven materials.

Further, it is known from U.S. Pat. No. 4,865,543 to use a burner with a heat radiation surface for heating an apparatus, a flat tube coil being guided as heat exchanger through its heating space. The fluid to be treated flows in the tube coil and is heated indirectly as a result of the heat radiation. As a result of the combustion, the heat radiator which is constructed as a fiber burner and arranged at the base of the heating space releases hot combustion gases which rise up and are carried out of the heating space at the top. The tube coil of the heat exchanger lies in a vertical plane and the tubes of the individual loops of the tube coil are arranged substantially horizontally.

Finally, a heating apparatus is known from EP 0 385 963 A1 which is formed from a cylindrical housing in which a likewise cylindrical ceramic hollow body with porous walls is arranged. Moreover, another cylindrical heat exchanger is installed in the housing at a distance from the cylindrical surface of the ceramic body, a heat carrier medium flowing through this cylindrical heat exchanger. A mixture of gaseous combustible material and an oxygen containing gas at above-atmospheric pressure is introduced in the intermediate space between the casing of the housing and the outer surface of the ceramic body. This mixture flows through the ceramic body and is burned when ignited on the inner surface of the ceramic body. The hot flue gases occurring as a result of the combustion can enter the hollow space enclosed by the heat exchanger through suitable through-openings in the outer surface area of the cylindrical heat exchanger while giving off heat and can be carried off from there to the outside. This heating apparatus in which a large portion of the heat absorbed by the heat exchanger is transmitted by convection is primarily conceived as a heating furnace for heating systems in buildings and is not suitable for implementing high temperature processes.

The fluid to be heated is introduced into the heat exchanger from above and drawn off again at the bottom so that the "transporting direction" of the tube coil is directed opposite to the upwardly directed flow of the combustion waste gases. Evaporated liquid combustibles such as kerosene, diesel, naphtha or alcohol are used for the combustion.

In this known apparatus the lower portions of the heat exchanger tube coil are exposed to an intensive heat radiation, while the upper portions can no longer be reached by the heat radiation of the burner and are substantially heated by convection. But the heat radiation can only act on a part of the tube surface even in the lowest heat exchanger tube.

Whereas the lateral regions of the horizontally disposed tubes are irradiated to a considerably lesser extent than the underside of the heat exchanger tube at the bottom, the upper sides of the heat exchanger tubes are not directly irradiated at all. This means that the flow of heat is subject to considerable fluctuations in the circumferential direction of the heat exchanger tubes as well as in the transporting direction of the heat exchanger.

A device for indirectly heating fluids is known from EP 0 233 030 A2, a plurality of rows of flat radiation burners arranged one on top of the other being mounted in its heating space at a distance from one another and so as to be parallel to one another. A tube heat exchanger with a plurality of substantially horizontally extending tube loops arranged substantially in two vertical parallel planes relative to the radiation burners is located in the intermediate spaces of these rows of burners. The intermediate spaces between every two directly adjacent tube loops are open. The distance from the effective radiation surfaces of the radiation burners as well as the irradiation angle of the heat radiation vary as seen along the tube circumference of the tube loops, so that the temperature of the tube wall is nonuniform along the tube circumference.

SUMMARY OF THE INVENTION

The object of the invention is to propose a device of the generic type for indirectly heating fluids in which a substantially more uniform flow of heat in the heat exchanger is ensured.

In accordance with the present invention, a pair of heat radiators having a heat radiation surface shaped corresponding to the planar extension of the tube coil is associated with the tube coil. The heat radiators are arranged on opposite sides of the tube coil. The tube of the tube coil is provided at its outer side with longitudinal ribs. The longitudinal ribs are located at two opposite sides with respect to the tube cross-section. The longitudinal ribs extend along the entire or almost entire length of the tube coil into an intermediate space located between the loops of the tube coil The invention provides that the tubes of the heat exchanger tube coils through which the fluid to be heated is guided are irradiated by two heat radiators located on opposite sides with reference to the tube axis and with reference to the surface in which the tube coil extends. Thus, every tube coil is arranged between two heat radiators whose heat radiation is directed toward one another, so that there is no longer any remote surface on the tube circumference that is not irradiated. Since the shape of the heat radiation surfaces of the heat radiators conforms to the planar extension of the heat exchanger tube coil, a uniform irradiation can also occur in the transporting direction of the heat exchanger.

However, the fact that the heat exchanger tube coils, as a rule, do not present a closed surface, but rather an open intermediate space remains between the individual loops, is problematic. This means that the heat radiation of the two heat radiators located opposite one another could pass through these intermediate spaces and lead to unwanted increases in temperature in the corresponding regions of the two heat radiation surfaces. Accordingly, not only would the uniformity of the temperature distribution of the heat radiation surfaces be impaired, but the radiation body of the heat radiators could also be damaged.

The invention therefore provides for the arrangement of two diametrically opposite longitudinal ribs at the outer side of the heat exchanger tubes, which longitudinal ribs extend along the entire, or almost the entire, length of the tubes and project into the intermediate spaces of the tube coils in each instance. These longitudinal ribs accordingly pose an obstacle to the passage of the heat radiation through the intermediate spaces of the tube coils. It is advisable to ensure the most complete possible covering of these intermediate spaces.

In addition to the shielding effect, another substantial aim is pursued within the framework of the invention with the longitudinal ribs. Since the longitudinal ribs can absorb considerable amounts of heat as a result of the heat irradiation, the flow of heat through the regions of the tube walls situated laterally to the radiating direction of the heat radiators, i.e. through the less intensively irradiated regions of the tube wall, can be intensified in that additional heat flows into these lateral regions by guiding heat out of the longitudinal ribs. The longitudinal ribs should therefore have the best possible contact with the tube surface (e.g. a weld connection). It may also be advisable to use a work material for the longitudinal ribs which has a greater thermal conductivity than the work material of the tubes.

Since the flow of heat is directly dependent on the cross-sectional surface area in the direction of flow, the thickness of the longitudinal ribs should, as far as possible, be designed in such a way that the reduction in the supply of heat into the lateral regions of the tubes resulting from the smaller extent of direct heat irradiation be virtually compensated for by the introduction of heat from the longitudinal ribs. The minimum thickness of the longitudinal ribs required for this can be determined in a known manner by calculation. In many cases, instead of longitudinal ribs with a uniform thickness, it may be advisable to use longitudinal ribs having an approximately trapezoidal cross section, wherein the thickness of the longitudinal ribs increases in the direction of the tube surface. In this way, heat can be conducted as favorably as in longitudinal ribs having a constant thickness along their entire height corresponding to the thickest point of the trapezoidal longitudinal rib, but with a decrease in total weight and reduced material expenditure.

The tube coil of the heat exchanger through which the fluid is guided advisably extends in a planar fashion, i.e. the loops of the tube coil lie in a plane. In principle, the heat exchanger can also extend in curved surfaces since the heat radiation surface can be adapted to this surface by shaping the radiation bodies in a corresponding manner. In such cases a cylindrical outer surface area is recommended for simplicity of production, wherein the heat exchanger tubes can be arranged e.g. in a helical line. This embodiment form is also included in the expression "tube coil". Alternatively, the tubes can also extend parallel to the cylindrical surface lines.

Of course, a plurality of tube coils can also be provided in the heating space of the device according to the invention as heat exchangers. A construction in which the tube coils are arranged parallel to one another in vertical planes is recommended. In so doing, the inventive principle remains unchanged in that two heat radiators located opposite one another are associated with every tube coil surface. It is possible to combine the heat radiators located between two adjacent tube coils with two heat radiating surfaces radiating in opposite directions in a single burner housing. To achieve approximately constant heating conditions along the entire length of the tube coil it is recommended to arrange the tube coils in their vertical plane in such a way that the parallel tube portions of the tube coil are vertically aligned. This means that the fluid to be heated is alternately guided down and then up again in the opposing tube portions of the individual loops of the tube coil and is transported in its entirety in the horizontal direction with reference to the longitudinal extension of the tube coil.

In this way a disturbing influence of the ascending hot flue gases which can lead to varying heating conditions when the tube portions are guided substantially horizontally is prevented to a great extent. If a plurality of parallel heat exchangers are provided, it is possible to connect the feed lines and drain lines for the fluid to the individual heat exchangers by a collecting line, i.e. a feed collector or drain collector.

It is also possible to arrange a plurality of heat exchangers within the same plane, the coils of the heat exchangers being interspersed one within another. In such cases the covering of the intermediate spaces between the heat exchanger tubes is achieved by the cooperation of the longitudinal ribs of a plurality of heat exchangers.

Since the heating conditions for a heat exchanger in the construction according to the invention are practically completely independent of the heating conditions of other heat exchangers in planes arranged parallel thereto because of the assignment of the heat radiators, it is easy to operate individual heat exchangers at different temperatures within the same heating space in contrast to the previous art. Moreover, one and the same heat exchanger can even be divided with reference to its transporting direction into e.g. two or three zones with differently controlled heating in that the associated heat radiation surface is divided in a corresponding manner and supplied with different amounts of combustible material. This is equivalent to a corresponding series connection of smaller heat radiators which can be operated independently and whose individual heat radiation surfaces complement one another to form a combined heat radiation surface corresponding to the surface area of the heat exchanger.

The conventional manner of construction does not allow such a controlled differential heating since the ascending combustion waste gases of the burner arranged at the bottom of the heating space inevitably influence the action of the burners arranged at the top. In contrast, the invention allows the temperature gradients of the fluid to be changed in a controlled manner on its path through the tube coils.

Although the invention can be realized with optional heat radiators constructed in a planar manner (e.g. electrically heated radiation elements), burners with porous radiation bodies are particularly suitable for economical reasons. Gaseous combustibles can be burned without flame on the glowing surface of the latter with oxygen containing gas. Ceramic fiber burners are particularly preferred.

This type of heat radiation source is characterized not only by simple handling, low pressure losses, quick response to load fluctuations and a low noise level, but particularly also by extraordinarily low values of nitrogen oxide (less than 20 ppm), carbon monoxide, and unburned combustibles in the combustion gas. As a result of the possibility of adapting the geometry of the heat radiation surface to the heat exchanger geometry and by avoiding the irregularities of an open flame as heat source the heat radiators and heat exchangers can be brought very close to one another without the danger of uncontrolled local overheating. Accordingly, the heat exchange can be maintained on an extremely efficient level even when the installation is to be operated only at low output. Heat radiators with a vertically arranged heat radiation surface are preferred. However, the invention can also be constructed with horizontal heat radiation surfaces.

BRIEF DESCRIPTION OF THE DRAWINGS

The invention is explained in more detail in the following with reference to FIGS. 1 to 7 in which parts having identical function are provided with identical reference numbers.

DESCRIPTION OF THE PREFERRED EMBODIMENTS

Figure 1:
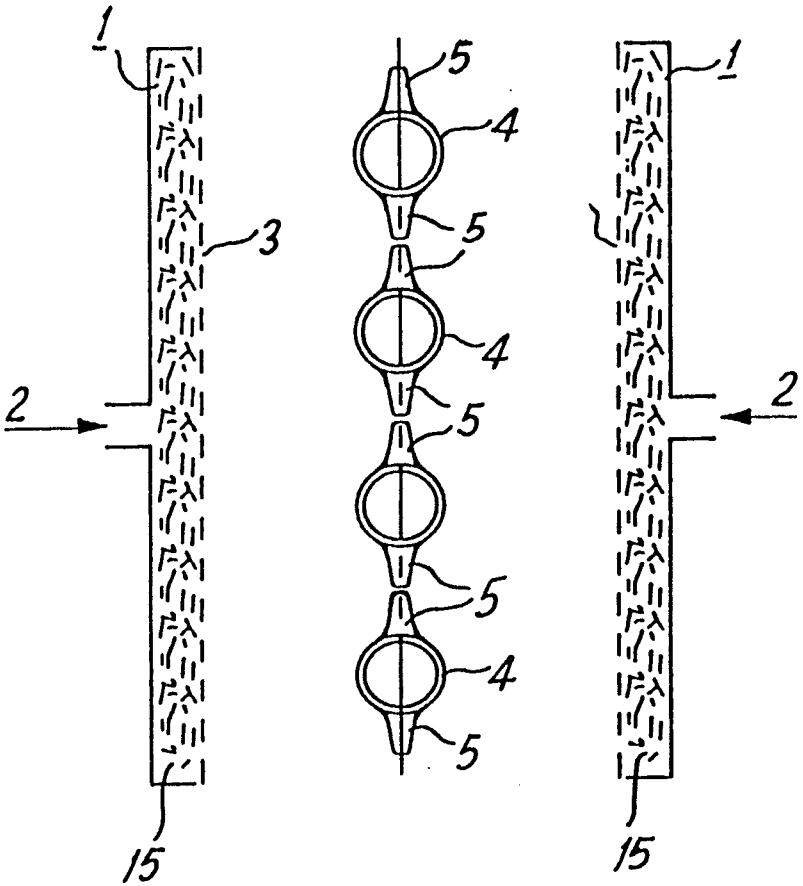
FIG. 1 shows a schematic cross section through a device according to the invention.

FIG. 1 shows a cross section through a tube coil 4 which lies in a vertical plane of a heating space 14 and is acted upon laterally with heat radiation by two heat radiators 1. The tubes of the tube coil 4 have longitudinal ribs 5 at their upper and lower sides, which longitudinal ribs 5 are located diametrically opposite one another, project out vertically and are welded externally with the tube.

The heat radiators 1 have a radiation body 15 of porous material (e.g. ceramic fiber material) embedded in a burner housing which is open toward the side facing the tube coil 4. A mixture of a gaseous combustible and an oxygen containing gas enters the burner housing through a gas inlet 2 and flows through the radiation body 15 so as to be uniformly distributed along the surface. The heat radiation surface 3 of the radiation body 15 glows and causes the ignition and combustion of the supplied gas mixture. This combustion takes place in the immediate vicinity of the radiation surface 3 so that there is practically no flame.

The heat radiation of the heat radiation surface 3 strikes the tubes of the tube coil 4 and their longitudinal ribs 5 and heats them. Since the longitudinal ribs 5 of pipeline portions of the tube coil 4 which are arranged one immediately on top of another lie close together or even abut one another with their outer end faces, the intermediate space between the tubes of the tube coil 4 is practically completely shielded from heat radiation passing directly through from one heat radiator 1 to the other heat radiator 1 so that the latter do not negatively influence one another. The heat absorbed by the longitudinal ribs 5 is transmitted by heat conduction into the wall of the tubes of the tube coil 4 and from the latter to the fluid flowing through it. While taking into account their thermal conductivity, the thickness of the longitudinal ribs 5 is designed in such a way that the flow of heat which can be guided through them is sufficient to compensate approximately for the heat absorption occurring in the upper and lower surface regions (in the region of the 12-o'clock and 6-o'clock positions) which is otherwise lower, per se, because of the decreased heat radiation in these regions (in comparison to the region of the 3-o'clock and 9-o'clock positions) or at least to reduce the differences considerably. This means that the fluid guided through the tube coil 4 encounters approximately the same thermal conditions with respect to the overall inner surface of the heat exchanger. This is not the case in conventional apparatuses for high temperature processes.

Figure 2B:
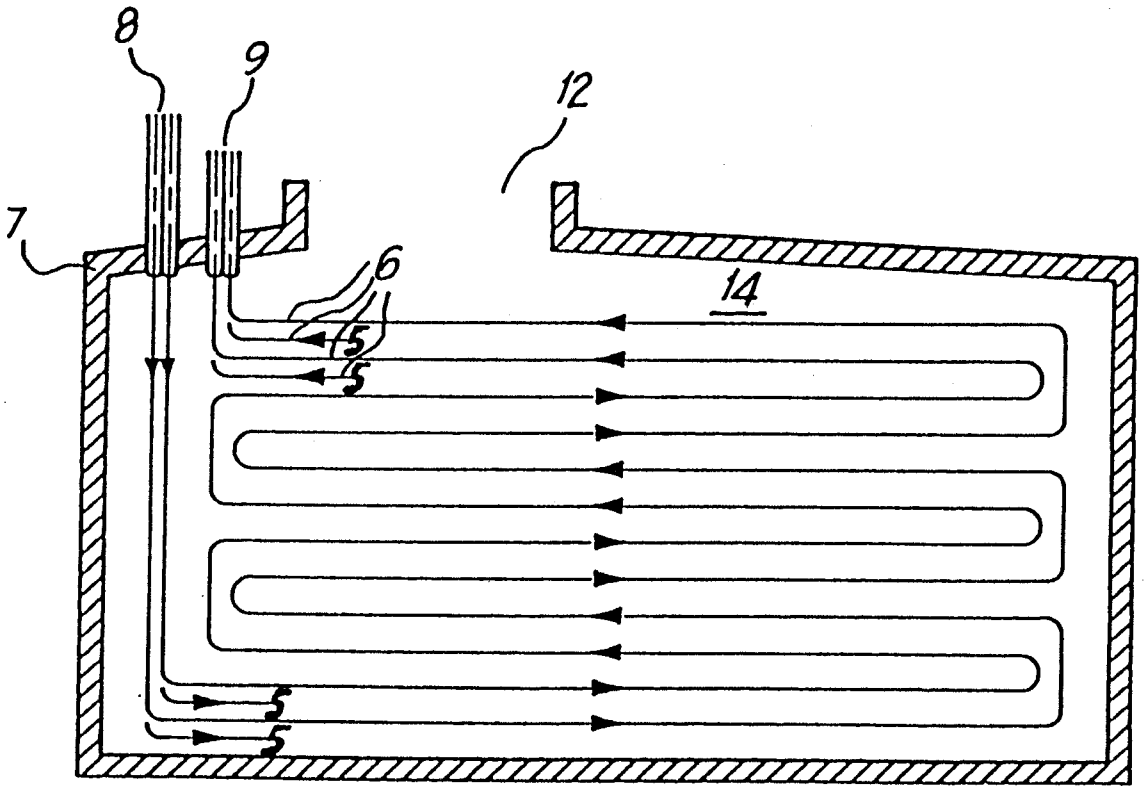
PRIOR ART FIG.2b
FIGS. 2*a* and 2*b* show a cross section and longitudinal section, respectively, through a conventional furnace for the pyrolysis of acetic acid.
Figure 2A:
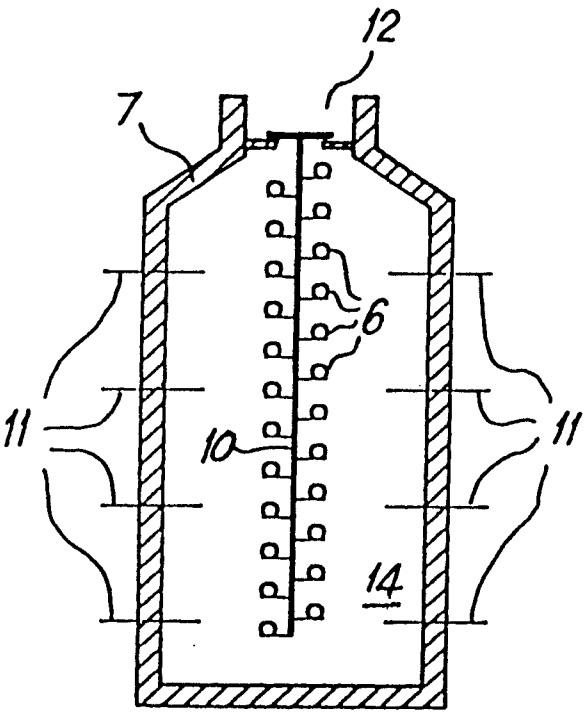
PRIOR ART FIG.2a

A reaction furnace, e.g. for the pyrolysis of acetic acid for the production of ketenes, is shown in FIGS. 2*a* and 2*b* to illustrate this. The heating space 14 is enclosed by a thermally insulated housing 7. The tube coils, designated by 6, of the two heat exchangers arranged in parallel vertical planes are supported in the heating space 14 on a suspending device 10, the acetic acid being guided through the tube coils 6.

As follows from FIG. 2*b*, the lowest heat exchanger tubes of the tube coils 6 are connected to the feed lines 8 and the uppermost heat exchanger tubes are connected to the drain lines 9 so that the transporting direction of the acetic acid through the heat exchanger is directed in principle from the bottom to the top, although the tube coils 6 extend substantially horizontally. Burners 11 (indicated schematically by dash-dot lines) are arranged in the housing wall 7 at both sides of the tube coils 6, the open flames of the burners 11 being directed toward the heat exchanger tubes. The combustion waste gases occurring as a result of the combustion are guided out of the heating space 14 at the top through the flue gas opening 12. It is evident that the individual surface regions of the tubes of the tube coils 6 are irradiated with heat at different intensities as was already explained above. This applies to the longitudinal extension of the tubes as well as to their circumferential direction, since the heat radiators (burners 11) are not constructed so as to have a large surface area and also no longitudinal ribs are provided at the tubes which could intensify the flow of heat in the regions which are less intensely irradiated.

The considerably more uniform introduction of heat into the heat exchanger tubes in the construction according to the invention provides that the heat exchangers can be operated at higher efficiency as a whole. This means either that a greater amount of heat can be transmitted with the same heat exchanging surface of a tube coil or the same amount of heat can be transmitted with a smaller heat exchanging surface with the same maximum allowable tube wall temperature.

In each of the heat exchangers heated by the heat radiators, the heat transmission output is always approximately a mean value between the maximum flow of heat into the regions of the heat exchanger tubes most exposed to the heat radiation and the minimum flow of heat into the regions of the heat exchanger tubes least exposed to the heat radiation. In conventional heat exchangers the ratio of the mean to maximum heat flow is approximately 1:1.2 in the most favorable case. In contrast, the construction according to the invention makes it possible to bring this ratio to almost 1:1, since the temperature is almost identical over the entire surface of the heat exchanger tubes.

The homogenization of the heat flow is also significant in that the maximum allowable tube wall temperature is not dependent solely on the temperature resistance of the tube material, but is also determined to a very substantial extent by the thermal characteristics of the heated fluid. For example, decomposition reactions (e.g. coke formation) can occur above determined critical temperatures, resulting in deposits on the inner surface of the heat exchanger tubes and accordingly in a growing deterioration of the heat transmission characteristics of the heat exchanger. The invention enables a type of operation in which even locally narrowly confined exceeding of the critical temperature limit is safely avoided without the need for distinctly lowering the temperature level of the heat exchanger on the average below this critical limit at the same time. By evening out the flow of heat on the circumference of the heat exchanger tubes, the tube wall temperature can be held at the maximum allowable value practically along the entire circumference.

Figure 3B:
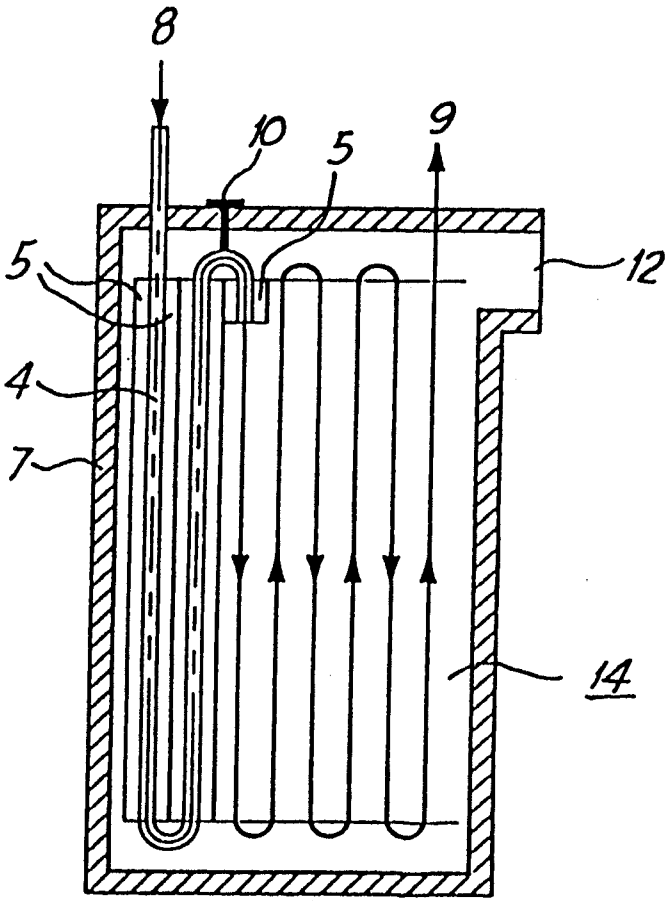
FIGS. 3*a*, 3*b* and 3*c* show a cross section and longitudinal section, respectively, through a furnace according to the invention for the pyrolysis of acetic acid.
Figure 3A:
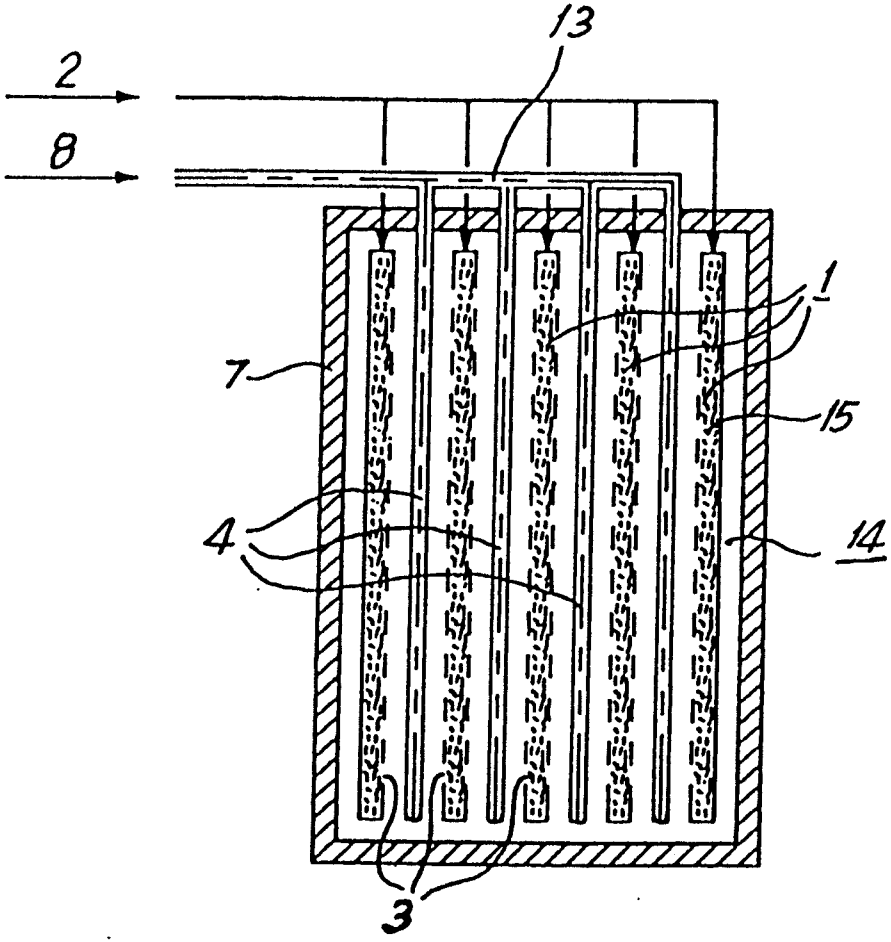
Figure 3C:
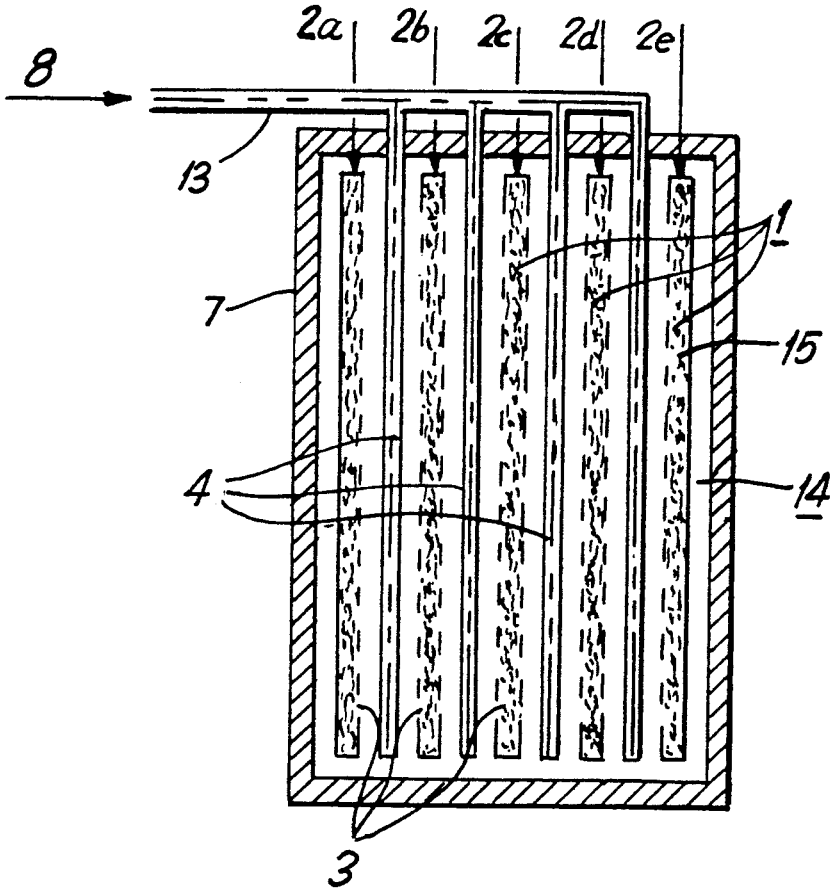

FIGS. 3*a* and 3*b* show a furnace, according to the present invention, corresponding to the furnace of FIGS. 2*a* and 2*b* in vertical longitudinal and cross section, respectively. Four tube coils 4 are arranged as heat exchanger tubes in parallel vertical planes in the heating space 14 enclosed by the housing 7. The feed 8 of the fluid to be heated to the tube coils 4 is effected through a common line (feed collector 13). In a corresponding manner, a drain collector (not shown) is provided for the drain 9 of the heated fluid. In contrast to the conventional construction corresponding to FIGS. 2*a* and 2*b*, the heat exchanger tubes of the tube coil 4 which are fastened at the suspending devices 10 at the housing 7 do not extend substantially horizontally within the vertical plane (in the parallel tube portions), but rather vertically. The general transporting direction of the fluid through the heat exchanger is therefore horizontal. A heat radiator 1 whose heat radiation surfaces 3 correspond in extent to the planar extension of the tube coil 4 is arranged in each instance on both flat sides of every tube coil 4 so as to be parallel to and at a distance from one another. The gas inlet 2 for supplying the heat radiator 1, which is constructed as a fiber burner, is constructed as a common collecting line. Alternatively, the gas inlet for supplying the heat radiator can be separate inlets 2*a*–2*e* (See FIG. 3*c*) which permit the heat output of the heat radiators to be independently controlled. The occurring combustion waste gases are guided out of the heating space 14 at the top through the flue gas opening 12. With the exception of the heat radiators 1 arranged at the outer sides, each heat radiator 1 is provided with two heat radiating surfaces 3 acting in opposite directions, i.e. like two separate heat radiators 1. As follows from FIG. 3*b*, the longitudinal ribs 5 arranged at the heat exchanger tubes of the tube coils 4 exclude an undesirable mutual influencing of the heat radiators which are directed opposite one another with respect to their radiating direction by completely shielding the intermediate space between the individual lengths of tubing running in opposite directions.

Moreover, the longitudinal ribs 5 ensure the above-described intensification of the heat flow in the regions of the heat exchanger tube walls which are less intensely affected by direct heat irradiation.

Since no open flames are used for heating in the construction according to the invention, the heat radiation surfaces 3 are brought up relatively close to the tube coils 4. This enables an extraordinarily compact construction of the device. In the conventional construction, bringing the burners with open flame closer together in this way would inevitably lead to local overheating at the heat exchanger tubes. Therefore, a conventional furnace has a substantially greater heating space volume with the same heat transmission output. For the construction according to the invention, this results in a reduction of the necessary space requirement to only one third of the previous value, as also follows by approximation from a comparison of FIGS. 2*b* and 3*b*. In addition, the radiation losses toward the outside are also reduced correspondingly by the smaller volume. Together with the increase in the efficiency of the heat transmission due to the proximity of the heat radiation surfaces 3 to the surface of the heat exchanger tubes, this leads as a whole to a clear economizing in the consumption of combustibles.

Figure 4:
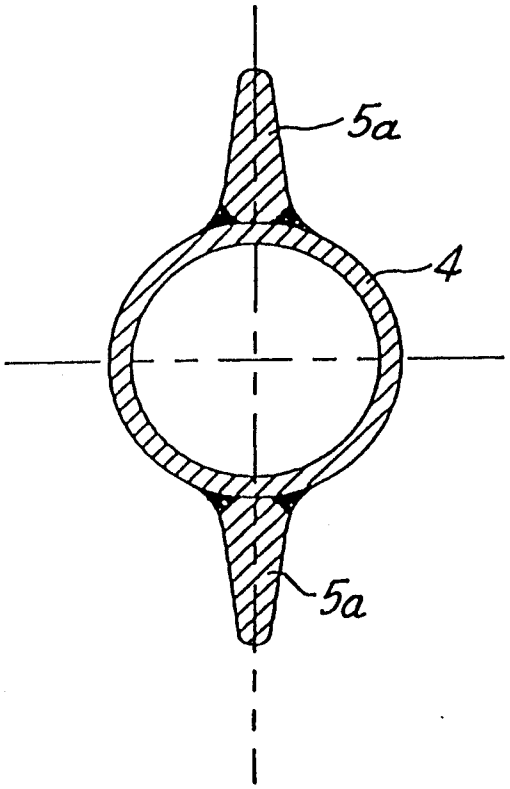
FIG. 4 shows a cross section through a heat exchanger tube with trapezoidal longitudinal ribs.

FIG. 4 shows an individual heat exchanger tube of a tube coil 4 whose longitudinal ribs 5*a* are approximately trapezoidal in cross section, the cross section widening toward the tube surface. This shape is suited to the fact that the heat must be guided off only in the direction of the heat exchanger tube and the amount of heat to be guided off increases steadily toward the tube surface along the height of the longitudinal rib. The thickness of the longitudinal ribs is thus designed as a function of the distance from the tube surface in such a way as to ensure that the minimum required cross section for the respective amount of heat is ensured.

This type of design leads to an economizing of material and weight compared to a design according to the maximum required cross section (constant along the entire height of the longitudinal ribs) without the heat conducting capacity of the longitudinal ribs 5*a* being impaired.

Figure 5:
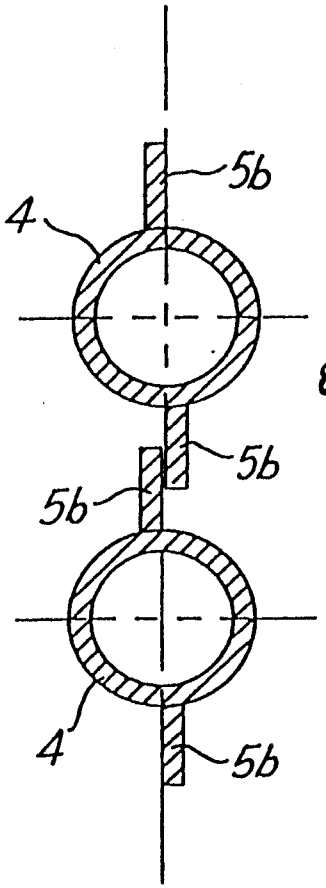
FIG. 5 shows a cross section through a loop of a heat exchanger tube coil with overlapped longitudinal ribs.

Whereas in FIG. 1 and FIG. 3*a* the longitudinal ribs 5 of two directly adjacent tube lengths of the tube coil 4 abut directly and are aligned with one another at their outer front sides, FIG. 5 shows a modification in which the longitudinal ribs 5*b* overlap one another in their vertical extension (from the tube surface). The advantage in this is that a complete shielding of the intermediate spaces between the lengths of the tube coil 4 can always be ensured. This could also be done by providing a single continuous plate as a common longitudinal rib for two adjacent oppositely running tube lengths in place of two longitudinal ribs. However, this would lead to considerable problems as a result of the anticipated thermal stresses in the construction. On the other hand, the solution according to FIG. 5 allows a free expansion of the tubes and longitudinal ribs 5*b* without a gap occurring in the intermediate space through which heat radiation could pass directly.

Figure 6:
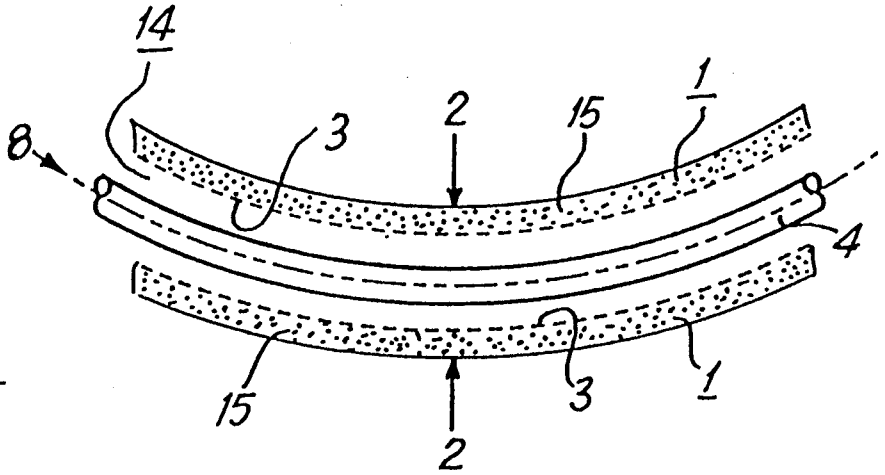
FIG. 6 shows a portion of a cross section through a device according to the invention with a heat exchanger tube coil constructed in the shape of a cylindrical casing.

FIG. 6 shows an embodiment form of the invention in section, in which the tube coil 4 and the heat radiation surfaces 3 of the radiation bodies 15 of the heat radiators 1 have a curved shape, i.e. that of a cylindrical casing. The tube coil 4 can be constructed in the form of parallel rings or also in the shape of a helical line. But the basic principle corresponds completely to the contents of FIGS. 1, 3*a* and 3*b*.

Figure 7:
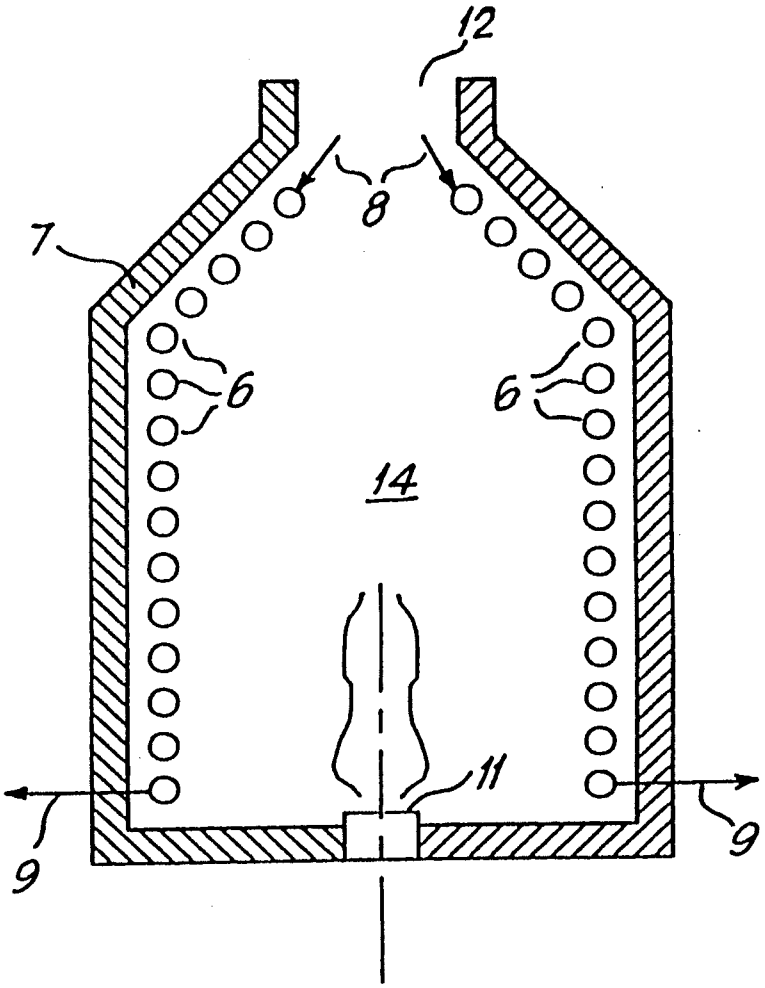
PRIOR ART FIG. 7
FIG. 7 shows a section through a conventional furnace for the preheating and evaporation of a liquid.

The efficiency of the construction according to the invention is particularly apparent when applied to a furnace for preheating and evaporating crude oil which is to be subjected to atmospheric distillation subsequently. The conventional construction is shown in FIG. 7. Burners 11 (only one of which is shown) which produce an upwardly directed open flame causing the heating of the tube coils 6 are arranged at the bottom of the heating space 14 of this furnace. The crude oil is introduced into the tube coils 6 through feed lines 8 in the vicinity of the flue gas opening 12 and is drawn off from the heating space 14 at the bottom through the outlet lines 9 after heating and partial evaporation have been effected and conveyed to the distillation unit (not shown). Since the tube coils 6 are arranged at the walls of the heating space 14, they receive the radiation heat of the burner flames from only one side. Therefore, considerable temperature differentials occur in a compulsory manner in the circumferential direction of the heat exchanger tubes. Moreover, greater differences in temperature also occur in the vertical direction along the tube coil 6 as a result of the varying distance of the individual tube surface regions from the center of the burner flames. The following table shows in detail the considerable advantages of a construction of such a furnace, according to the invention, in which longitudinal ribs are arranged at the heat exchanger tubes and the tube coils are provided with heat radiation from two sides in comparison to a furnace according to FIG. 7:

| | Conventional furnace | furnace according to the invention |
|---|---|---|
| absorbed heat (kCal/h) | 49,168,000 | 49,168,000 |
| burner type | with open flame and natural draft | with heat radiation surface |
| quantity of burners | 36 | 35 |
| consumed combustible material (kCal/h) | 83,103,000 | 52,680,000 |
| average heat flow | 30,100 | 42,140 |
| tube coil surface ($m^2$) | 1,652 | 1,169 |
| construction of tube coils | horizontal | vertical |
| heating space volume ($m^3$) | 1,813 | 616 |
| heating space surface ($m^2$) | 967 | 442 |
| $NO_x$ emission (kg/h) | 13.7 | 2.3 |

The consumption of combustibles by the furnace according to the invention is 37% lower and the emission of nitrogen oxides is reduced by more than 80% compared to the conventional furnace with the same heat transmission output. The construction is also considerably more compact, which is documented by the fact that the tube coil surface is reduced by approximately 30%, the volume of the heating space is reduced by 66%, and the surface of the heating space is 54% smaller.

We claim:

1. A device for indirectly heating fluids, particularly for high temperature processes, having a heating space in which at least one tube coil is arranged which is constructed in a planar manner and through which the fluids to be heated can be guided and which can be acted upon the outside by the radiation heat of the heat radiator, the device comprising a pair of heat radiators (1) having a heat radiation surface (3) shaped corresponding to the planar extension of the tube coils (4) associated with the tube coil (4), the heat radiators (1) being arranged on opposite sides of the tube coil (4), a tube of the coil (4) being provided at an outer side thereof with longitudinal ribs (5, 5*a*, 5*b*) at two sides which lie opposite one another with reference to the tube cross section, which longitudinal ribs (5, 5*a*, 5*b*) extend along the entire, or virtually the entire, length of the tube coil (4) into the intermediate space situated between the loops of the tube coil (4).

2. The device according to claim 1, wherein the longitudinal ribs (5, 5*a*, 5*b*) have a height which ensures a complete or virtually complete covering of the intermediate space situated between the loops of the tube coil (4).

3. The device according to claim 1, wherein the longitudinal ribs (5*a*) are constructed so as to be approximately trapezoidal in cross section, their thickness increasing in the direction of the surface of the tubes of the tube coil (4).

4. The device according to claim 1, wherein the tube coil (4) and the heat radiators (1) extend in a planar surface.

5. The device according to claim 1, wherein the tube coil (4) and the heat radiators (1) extend in a curved surface.

6. The device according to claim 1, wherein a plurality of tube coils (4) and a plurality of pairs of heat radiators (1) are arranged in the heating space (14).

7. The device according to claim 6, wherein the tube coils (4) and the heat radiators (1) extend parallel to one another in a vertical plane.

8. The device according to claim 1, wherein the tubes of the tube coil (4) extend predominantly vertically.

9. The device according to claim 6, further comprising a feed collector (13) for conducting the fluid to be heated to the tube coils (4) and a discharge collector for conducting the fluid to be heated away from the tube coils (4).

10. The device according to claim 6, comprising means for regulating the heating output of the pair of heat radiators (1) associated with one tube coil (4) independently of the heat radiators (1) of other tube coils (4).

11. The device according to claim 5, wherein the tube coil and the heat radiators extend in a surface with a cylindrical outer surface area.

12. The device according to claim 1, wherein adjacent tubes of the tube coil have overlapping longitudinal ribs.

* * * * *